US010313799B2

(12) United States Patent
Yoo

(10) Patent No.: US 10,313,799 B2
(45) Date of Patent: Jun. 4, 2019

(54) MICROPHONE AND METHOD FOR MANUFACTURING THE SAME

(71) Applicants: HYUNDAI MOTOR COMPANY, Seoul (KR); KIA MOTORS CORPORATION, Seoul (KR)

(72) Inventor: Ilseon Yoo, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/824,321

(22) Filed: Nov. 28, 2017

(65) Prior Publication Data

US 2019/0082268 A1 Mar. 14, 2019

(30) Foreign Application Priority Data

Sep. 13, 2017 (KR) ..... 10-2017-0117082

(51) Int. Cl.

| | |
|---|---|
| ***H04R 25/00*** | (2006.01) |
| ***H04R 19/04*** | (2006.01) |
| ***H04R 31/00*** | (2006.01) |
| ***H04R 19/00*** | (2006.01) |

(52) U.S. Cl.

CPC ..... *H04R 19/04* (2013.01); *H04R 19/005* (2013.01); *H04R 31/00* (2013.01)

(58) Field of Classification Search

CPC ..... H04R 19/04; H04R 19/005; H04R 31/00

USPC ..... 381/174

See application file for complete search history.

(56) References Cited

U.S. PATENT DOCUMENTS

| | | | | |
|---|---|---|---|---|
| 8,531,088 | B2 | 9/2013 | Grosh et al. | |
| 8,565,452 | B2 * | 10/2013 | Coronato | B81B 3/0072 381/174 |
| 9,340,413 | B2 * | 5/2016 | Merassi | B81B 3/0072 |
| 2002/0067663 | A1 * | 6/2002 | Loeppert | B81B 3/0072 367/181 |
| 2010/0158280 | A1 * | 6/2010 | Coronato | B81B 3/0072 381/174 |

FOREIGN PATENT DOCUMENTS

| | | | |
|---|---|---|---|
| JP | 5325630 | B2 | 10/2013 |
| KR | 10-1514543 | B1 | 4/2015 |

* cited by examiner

*Primary Examiner* — Phylesha Dabney

(74) *Attorney, Agent, or Firm* — Morgan Lewis & Bockius LLP

(57) ABSTRACT

A microphone includes: a vibration electrode disposed in an upper portion of a substrate which has an acoustic hole; a fixed electrode separated from the upper portion of the vibration electrode by a reference distance and having an insulation membrane on each of an upper surface and a lower surface of the fixed electrode; and a piezoelectric electrode having a plurality of beams disposed in a radial direction outwards from a center of an upper portion of the fixed electrode and uniformly maintaining a space between the vibration electrode and the fixed electrode by bending the fixed electrode in one direction according to an input voltage.

17 Claims, 9 Drawing Sheets

MICROPHONE AND METHOD FOR MANUFACTURING THE SAME

CROSS-REFERENCE TO RELATED APPLICATION

This application claims the benefit of priority to Korean Patent Application No. 10-2017-0117082 filed in the Korean Intellectual Property Office on Sep. 13, 2017, the entire content of which is incorporated herein by reference.

TECHNICAL FIELD

The present disclosure is related to a microphone and a method for manufacturing the microphone.

BACKGROUND

In general, a microphone is a device converting sound into an electrical signal. Microphones may be used to various applications such as mobile communication devices like smartphones, earphones or hearing aids.

The microphones have been increasingly downsizing in recent years, and accordingly, micro electro mechanical system (MEMS) microphones employing the MEMS technology have been developed.

The MEMS microphones are manufactured through a semiconductor batch process. They are more resistant to moisture and heat than the conventional ECMs (Electret Condenser Microphones) and are well-suited for downsizing and easily integrated into a signal processing circuit.

These MEMS microphones are classified into a piezoelectric type and a capacitive type.

The piezoelectric type MEMS microphone consists of a vibration membrane only. When a vibration membrane is deformed by external sound pressure, an electrical signal is generated due to a piezoelectric effect, by which the sound pressure is measured.

The capacitive type MEMS microphone includes a vibration membrane and a fixed membrane. When the vibration membrane is subject to an inflow of external sound pressure, capacitance between the vibration and fixed membranes changes as the gap between them is varied due to vibration of the vibration membrane. Here, the varying capacitance value is output as a voltage signal and is expressed as sensitivity, which is one of important performance indices.

The current MEMS microphones under development are unchangeable due to the fixed gap between the vibration and fixed membranes. The gap between the vibration and the fixed membrane may change according to residual stress of the vibration or the fixed membrane and the thickness of a sacrificial layer deposited between the membranes.

The gap between the vibration and the fixed membrane exerts a large influence over the sensitivity and the noise, which are the most important performance indices of the MEMS microphone. In this regard, research and development for ensuring reproducibility is most needed.

The specifics in this background section are intended to enhance understanding of the background of the invention and may include those specifics not belonging to the conventional art already known to those skilled in the art to which the present disclosure belongs.

SUMMARY

An exemplary embodiment of the present disclosure provides a microphone that exhibits improved sensitivity and a method for manufacturing the microphone. The microphone is structured so that a piezoelectric electrode is applied to an upper portion of a fixed electrode, the central portion of the fixed electrode is bent in one direction together with the piezoelectric electrode as a vibration electrode vibrates, and thereby the gap between the vibration and the fixed electrode is kept to be uniform over the whole electrode area.

In one exemplary embodiment of the present disclosure, a microphone comprises: a vibration electrode disposed in an upper portion of a substrate having an acoustic hole; a fixed electrode separated from the upper portion of the vibration electrode by a fixed distance and having an insulation membrane on each of an upper surface and a lower surface of the fixed electrode; and a piezoelectric electrode having a plurality of beams disposed in a radial direction outwards from a center of an upper portion of the fixed electrode and uniformly maintaining a space between the vibration electrode and the fixed electrode by bending the fixed electrode in one direction according to an input voltage. The vibration electrode may include a plurality of inflow holes penetrating a portion corresponding to the acoustic hole.

A first sacrificial layer may be disposed between the vibration electrode and the substrate.

The fixed electrode may be disposed being separated from the vibration electrode by using a second sacrificial layer formed on an upper portion of the vibration electrode.

A plurality of air holes may be formed on the fixed electrode, the air holes penetrating the remaining area except for the portion in which the piezoelectric electrode is formed.

The fixed electrode may further comprise a plurality of flexible spring extending outwards along an edge.

The flexible spring may be disposed in a regular fashion along the circumference of the fixed electrode in the remaining area except for a portion in which the piezoelectric electrode is disposed.

A metallic layer may be disposed on each of the upper and the lower surface of the piezoelectric electrode.

The piezoelectric electrode may be made of a piezo material including PZT.

The microphone may further comprise a first electrode pad connected with the vibration electrode and a second electrode pad connected with the fixed electrode, wherein the first electrode pad and the second electrode pad may be connected electrically with a semiconductor chip.

The exemplary embodiment of the present disclosure provides an advantageous effect of improving sensitivity of a microphone by implementing a structure so that a piezoelectric electrode is applied to an upper portion of a fixed electrode, the central portion of the fixed electrode is bent in one direction along which the vibration electrode vibrates, and thereby the gap between the vibration and the fixed electrode is kept to be uniform over the whole electrode area.

In addition to the aforementioned advantageous effect, an effect that may be obtained or anticipated by applying an exemplary embodiment of the present disclosure will be disclosed explicitly or implicitly in the detailed description of the exemplary embodiment of the present disclosure. In other words, various effects expected by applying an exemplary embodiment of the present disclosure will be disclosed within the detailed description to be provided later.

DETAILED DESCRIPTION OF THE EMBODIMENTS

In what follows, an exemplary embodiment of the present disclosure will be described with reference to accompanying drawings. However, it should be noted that the drawings and the detailed descriptions provided below are related to one preferred exemplary embodiment from among various exemplary embodiments for describing features of the present disclosure effectively. Therefore, the present disclosure is not limited to the drawings and the descriptions provided below.

Figure 1:
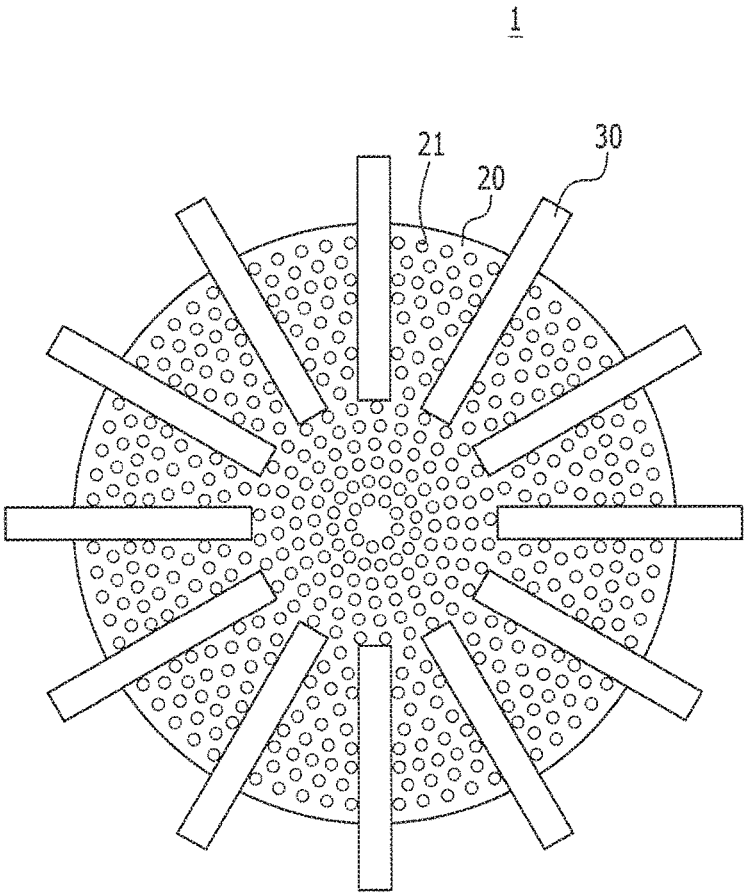
FIG. 1 is a top plan view of a microphone according to a first exemplary embodiment of the present disclosure.
Figure 2:
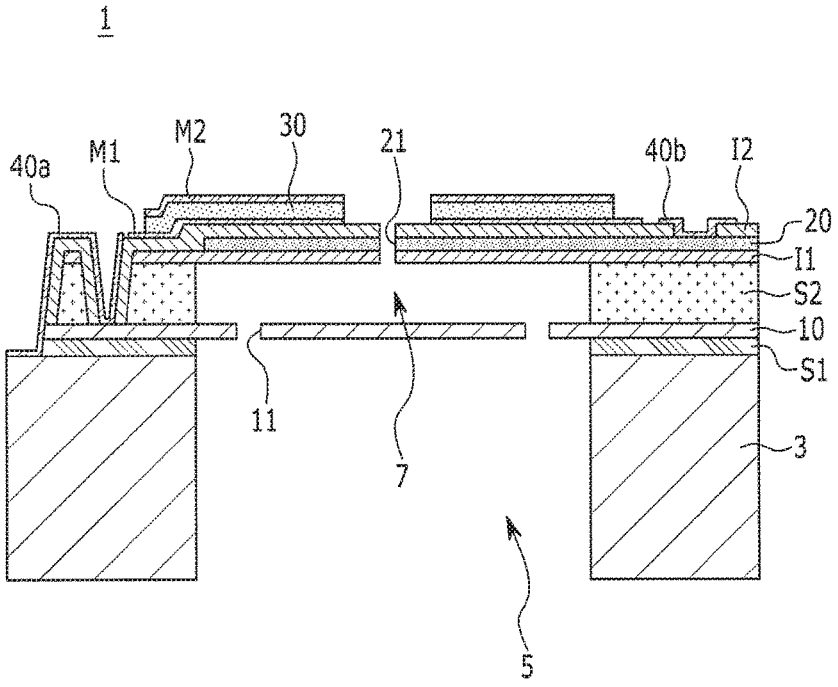
FIG. 2 is a cross-sectional view of FIG. 1.

FIG. 1 is a top plan view of a microphone according to a first exemplary embodiment of the present disclosure, and FIG. 2 is a cross-sectional view of FIG. 1.

A microphone 1 according to a first exemplary embodiment of the present disclosure is based on a capacitive type micro electro mechanical system (MEMS) component employing the MEMS technology.

Referring to FIGS. 1 and 2, the microphone 1 according to a first exemplary embodiment of the present disclosure comprises a vibration electrode 10, a fixed electrode 20, and a piezoelectric electrode 30.

The vibration electrode 10 is disposed on an upper portion of a substrate 3.

The vibration electrode 10 is bonded to the upper surface of the substrate 3 via a first sacrificial layer S1 between the substrate 3 and the vibration electrode 10.

The substrate 3 includes an acoustic hole 5 in the central portion thereof and is made of a silicon wafer.

The vibration electrode 10 covers the acoustic hole 5 of the substrate 3.

In other words, a portion of the vibration electrode 10 is exposed to the outside by the acoustic hole 5.

A portion of the vibration electrode 10 exposed by the acoustic hole 5 vibrates according to a sound source transmitted from an acoustic processor (not shown).

At this time, the acoustic hole 5 is a passage through which an inflow of a sound source generated from an external acoustic processor is made.

Here, the acoustic processor processes the user's voice and corresponds to at least one of a voice recognition device, a hands-free device, and a portable communication terminal.

The voice recognition device recognizes a voice command from the user and performs a function corresponding to the voice command.

The hands-free device, being connected with a portable communication terminal through short-range wireless communication, enables the user to use the portable communication terminal freely without using the hands of the user.

The portable communication terminal is a device allowing the user to communicate wirelessly and may include a smartphone and a personal digital assistant (PDA).

The vibration electrode 10 has a planar circular shape.

A plurality of inflow holes 11 may be formed in the area of the vibration electrode 10 corresponding to the acoustic hole 5, the inflow holes penetrating the vibration electrode 10.

The vibration electrode 10 may be made of poly-silicon material. However, the present disclosure is not necessarily limited to the exemplary embodiment, and any material with conductivity may be applied instead.

The fixed electrode 20 is disposed being separated by a predetermined distance from the vibration electrode 10 at the upper portion thereof 10.

In other words, the fixed electrode 20 is separated from the vibration electrode 10 via a second sacrificial layer S2 disposed on the upper portion of the vibration electrode 10.

A first insulating layer I1 and a second insulating layer I2 are disposed on the lower and the upper surface of the fixed electrode 20, respectively.

In other words, the fixed electrode 20 is disposed between the first insulating layer I1 and the second insulating layer I2.

The first and second insulating layer I1 and I2 encapsulate the fixed electrode 20 and insulate the fixed electrode 20.

The fixed electrode 20 may be made of poly-silicon material in the same manner as the vibration electrode 10. However, the present disclosure is not necessarily limited to the exemplary embodiment, and any material with conductivity may be applied instead.

Further, a plurality of air hole 21 is formed on the remaining area of the fixed electrode 20 except for the portion thereof 20 in which a piezoelectric electrode 30 described later is formed.

The air hole 21 is a hole through which the air passes or into which a sound source from a sound processing apparatus flows.

The piezoelectric electrode 30 is disposed on the upper portion of the fixed electrode 20.

In other words, the piezoelectric electrode 30 contacts the second insulating layer I2 formed on the upper surface of the fixed electrode 20.

In addition, a first metallic layer M1 and a second metallic layer m2 are disposed on the lower and the upper surface of the piezoelectric electrode 30, respectively.

In other words, the piezoelectric electrode 30 is disposed between the first metallic layer M1 of the lower surface and the second metallic layer M2 of the upper surface.

At this time, the exemplary embodiment assumes that the piezoelectric electrode 30 is made of a piezo-material including PZT. However, the present disclosure is not necessarily limited to the exemplary embodiment, and any material producing the same effect as the PZT may also be employed.

The piezoelectric electrode 30 is shaped in the form of a plurality of beams disposed in radial direction outwards from the center.

The piezoelectric electrode 30 may be formed within the upper surface of the fixed electrode 20 or outside the fixed electrode 20 with respect to the area of the upper surface of the fixed electrode 20.

The piezoelectric electrode 30 bends the fixed electrode 20 in one direction according to an input voltage.

In other words, piezoelectric electrode 30 deforms together with the fixed electrode 20 by the voltage applied as the vibration electrode 10 vibrates.

At this time, the piezoelectric electrode 30 is deformed in the same direction as the vibration direction of the vibration electrode 10.

Accordingly, the distance between the vibration electrode 10 and the fixed electrode 20 is kept to be uniform over the whole electrode area independently of the vibration of the vibration electrode 10.

The microphone 1 includes a first electrode pad 40*a* connected electrically with the vibration electrode 10 and a second electrode pad 40*b* connected electrically with the fixed electrode 20.

The first electrode pad 40*a* and the second electrode pad 40*b* are formed so as to be electrically connected to an external semiconductor chip (not shown).

Figure 3:
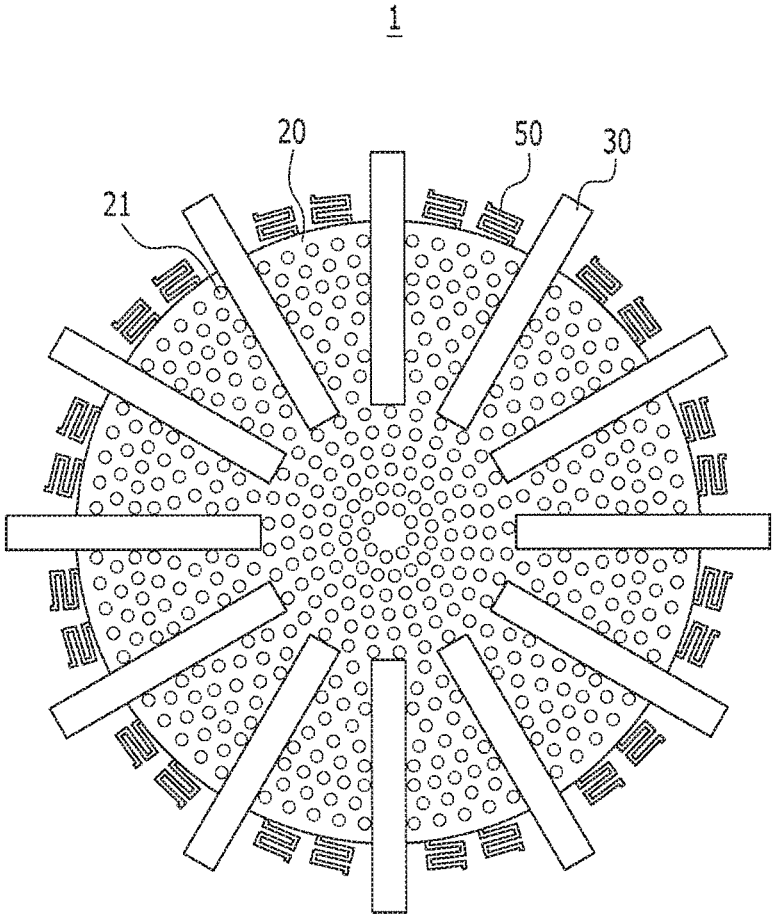
FIG. 3 is a top plan view of a microphone according to a second exemplary embodiment of the present disclosure.

FIG. 3 is a top plan view of a microphone according to a second exemplary embodiment of the present disclosure.

In describing a microphone according to a second exemplary embodiment of FIG. 3, for the convenience of understanding, the same structure and repeating descriptions of the microphone according to the first exemplary embodiment of FIGS. 1 and 2 will be omitted.

In other words, the microphone 1 according to the second exemplary embodiment of the present disclosure, while being based on the structure of the microphone according to the first exemplary embodiment of FIGS. 1 and 2, further comprises a flexible spring 50.

The flexible spring 50 is formed, extending outwards along the edge of the fixed electrode 20.

In other words, the flexible spring 50 is disposed regularly between the piezoelectric electrodes 30 disposed radially along the circumference of the fixed electrode 20.

The flexible spring 50 is formed to allow the fixed electrode 20 deformed more easily when the fixed electrode 20 and the piezo electrode 30 are deformed together.

Two flexible springs 50 may be formed between every pair of piezoelectric electrodes 30 comprising a plurality of beams. However, the present disclosure is not necessarily limited to the specific exemplary embodiment, and the number of flexible springs 50 may be changed depending on the needs.

Figure 4A:
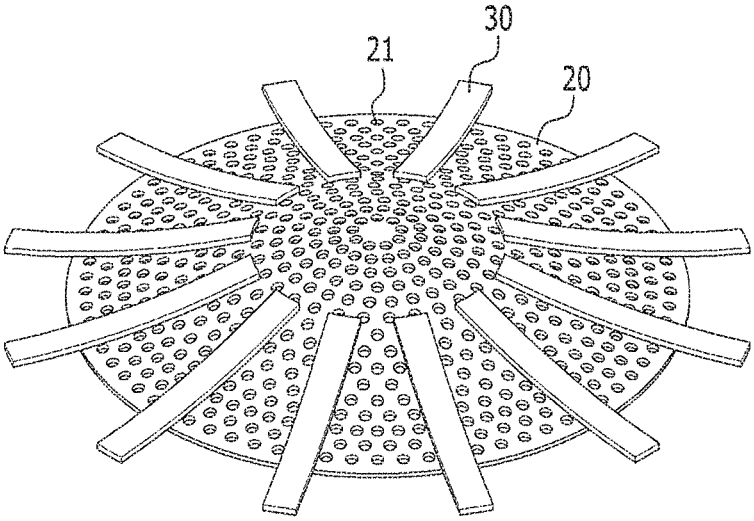
FIGS. 4A and 4B are operational views of a microphone according to an exemplary embodiment of the present disclosure.
Figure 4B:
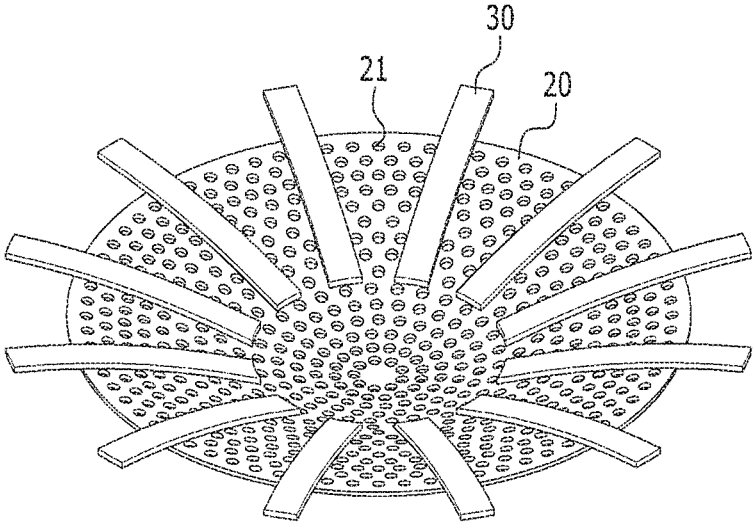

FIGS. 4A and 4B are operational views of a microphone according to an exemplary embodiment of the present disclosure.

Referring to the microphone 1 according to an exemplary embodiment of the present disclosure shown in FIGS. 4A and 4B, the vibration electrode 10 vibrates due to the inflow of an external sound. A voltage signal is applied to the piezoelectric electrode 30 according to the vibration and drives the piezoelectric electrode 30.

Here, the piezoelectric electrode 30 may be bent together with the fixed electrode 20 in one direction along which the vibration electrode 10 is bent.

For example, the piezoelectric electrode 30 is bent to allow a portion thereof 30 close to the central portion of the fixed electrode 20 be disposed upwards more than other portions so that the central portion of the fixed electrode 20 is deformed upwards and convexly (refer to FIG. 4A)

On the other hand, the piezoelectric electrode 30 is bent to make one portion close to the central portion of the fixed electrode 20 be disposed downwards more than other portions so that the central portion of the fixed electrode 20 is deformed downwards and convexly (refer to FIG. 4B).

In other words, if the central portion of the vibration electrode 20 is bent upwards and convexly, the piezoelectric electrode 30 deforms the central portion of the fixed electrode 20 upwards and convexly; in the same manner, if the central portion of the vibration electrode 10 is bent downwards and convexly, the piezoelectric electrode 30 deforms the central portion of the fixed electrode downwards and convexly.

Since the piezoelectric electrode 30 deforms the fixed electrode 20 according to the vibration of the vibration electrode 10, the gap between the vibration electrode 10 and the fixed electrode 20 is kept to be uniform over the whole electrode area.

FIGS. 5 to 9 are process views sequentially illustrating a manufacturing process of a microphone according to an exemplary embodiment of the present disclosure.

In what follows, described will be a method for manufacturing the microphone as structured above.

Figure 5:
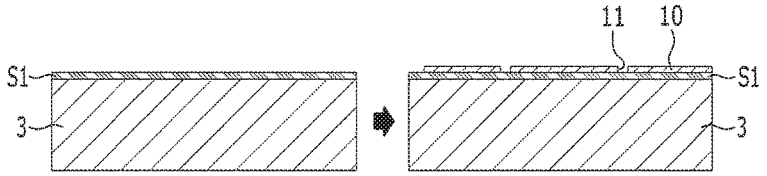
FIGS. 5 to 9 are process views sequentially illustrating a manufacturing process of a microphone according to an exemplary embodiment of the present disclosure.

Referring to FIG. 5, a first sacrificial layer S1 is formed on the upper portion of a substrate 3.

In other words, the first sacrificial layer S1 is deposited over the whole upper portion of the substrate 3.

The vibration electrode 10 is formed on the upper portion of the first sacrificial layer S1, and a plurality of inflow holes 11 are formed penetrating the vibration electrode 10.

Figure 6:
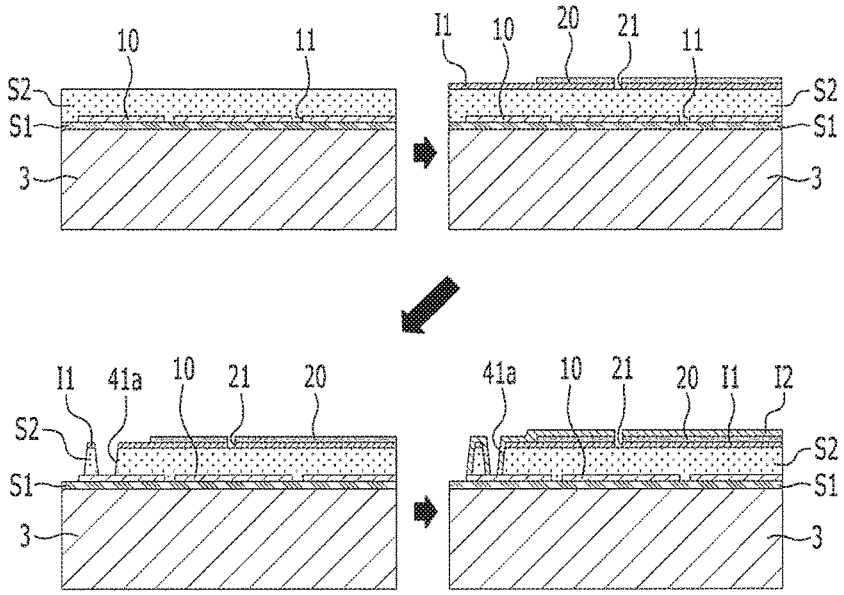

Referring to FIG. 6, a second sacrificial layer S2 is formed on the upper portion of the vibration electrode 10.

A first insulating layer I1 is formed on the upper portion of the second sacrificial layer S2.

A fixed electrode 20 is formed on the upper portion of the first insulating layer I1, and a plurality of air holes 21 are formed penetrating the first insulating layer I1 and the fixed electrode 20 simultaneously.

Next, the second sacrificial layer S2 and a portion of the first insulating layer I1 are etched to form a first electrode pad groove 41*a* connected with the vibration electrode 10.

A second insulating layer I2 is formed in the remaining area of the first insulating layer I1 and the upper portion of the fixed electrode 20 except for the air hole 21 and the first electrode pad groove 41*a*.

At this time, a flexible spring 50 according to a second exemplary embodiment of the present disclosure may be formed simultaneously while the first insulating layer I1, the fixed electrode 20, and the second insulating layer I2 are formed.

The flexible spring 50 may be formed in a desired shape along the edge by etching the first insulating layer I1, the fixed electrode 20, and the second insulating layer I2.

The flexible spring may be formed by extending the first insulating layer I1, the fixed electrode 20, and the second insulating layer I2 outwards and etching them in a desired shape.

Figure 7:
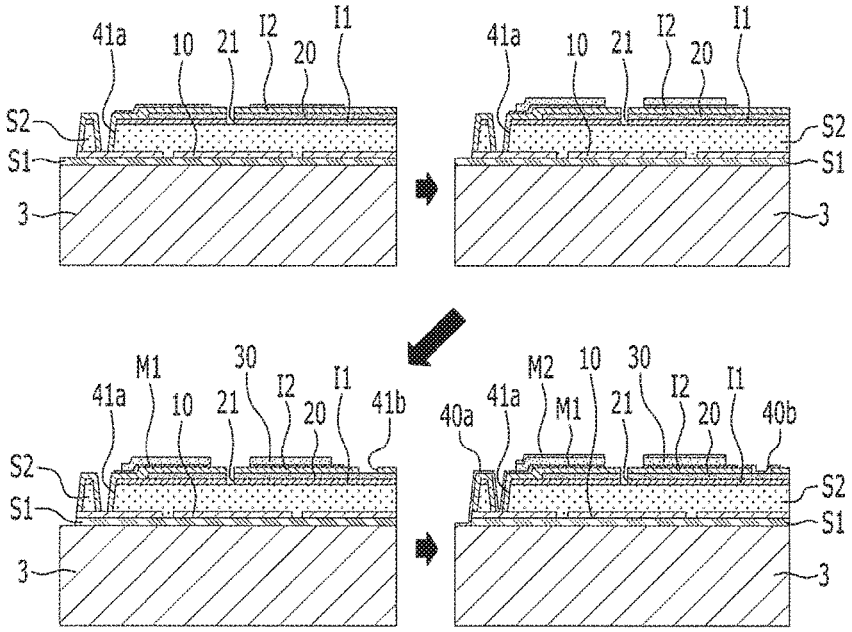

Referring to FIG. 7, a first metallic layer M1 is formed on the upper portion of the fixed electrode 20.

In other words, the first metallic layer M1 contacts the second insulating layer I2 formed on the upper surface of the fixed electrode 20.

A piezoelectric electrode 30 is formed on the upper portion of the first metallic layer M1.

Next, a second electrode pad groove 41*b* is formed, which is connected with the fixed electrode 20.

Next, a first electrode pad 40*a* connected with the vibration electrode 10 and a second electrode pad 40*b* connected with the fixed electrode 20 are formed.

At this time, the first electrode pad 40*a* is formed on the first electrode pad groove 41*a*, and the second electrode pad 40*b* is formed on the second electrode pad groove 41*b*.

Figure 8:
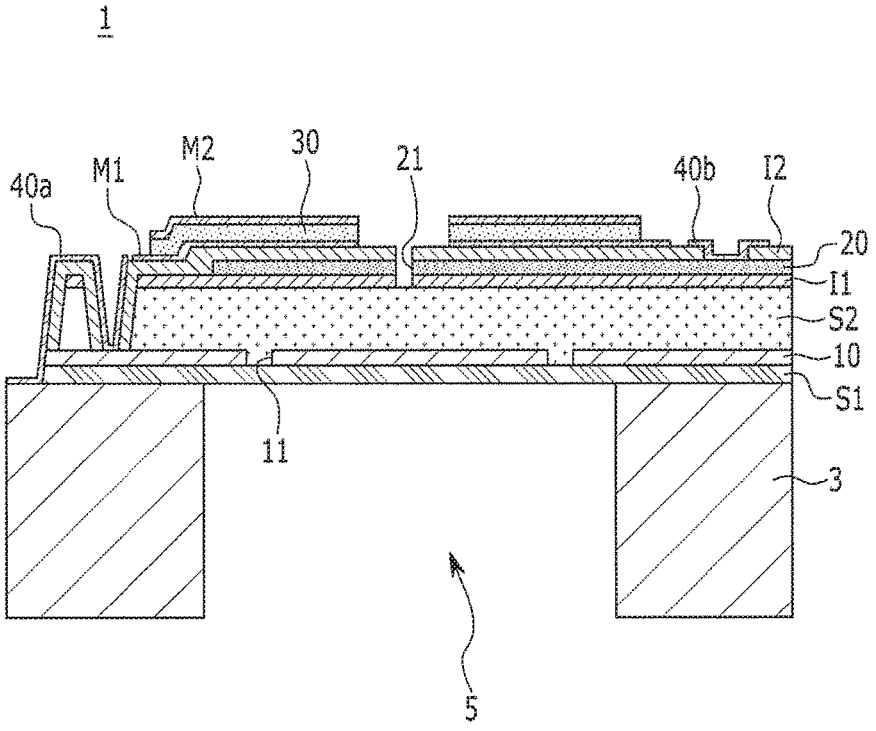

Referring to FIG. 8, an acoustic hole 5 is formed by etching the central portion of the substrate 3.

Figure 9:
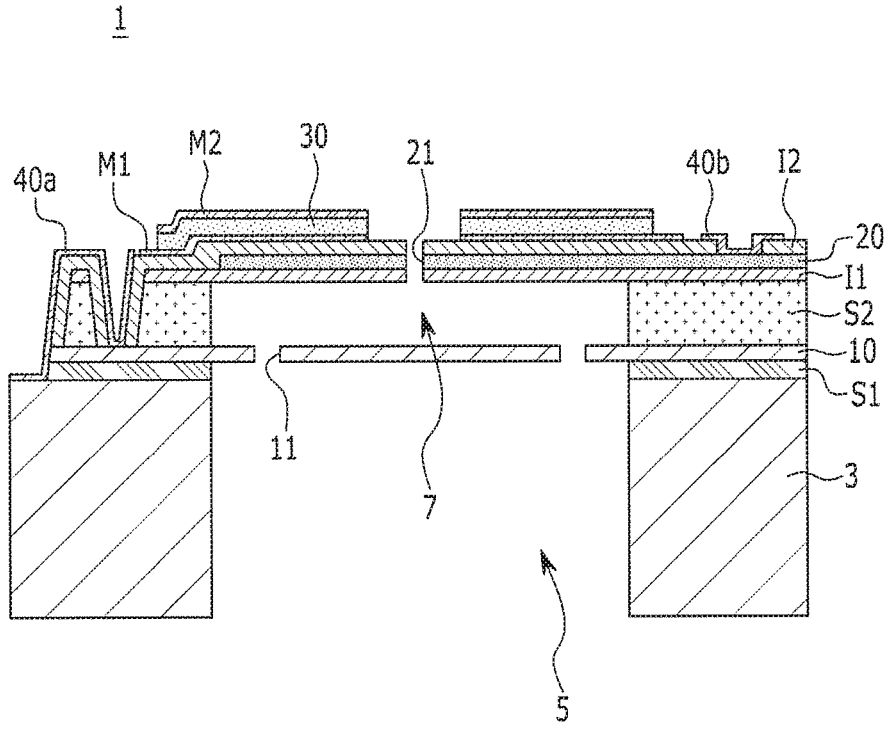

Referring to FIG. 9, an air layer 7 is formed between the vibration electrode 10 and the fixed electrode 20 by removing the first sacrificial layer S1 and the second sacrificial layer S2 corresponding to the acoustic hole 5.

At this time, the air layer 7 prevents the vibration electrode 10 and the fixed electrode 20 from being contacted to each other when they are subject to vibration.

Therefore, a microphone according to the exemplary embodiments of the present disclosure and a method for manufacturing the microphone bends the piezoelectric electrode 30 and the fixed electrode 20 together in one direction along which the vibration electrode 10 vibrates according to the inflow of an external sound, thereby keeping the distance between the vibration electrode 10 and the fixed electrode 20 to be uniform.

Accordingly, sensitivity is improved as the distance between the vibration electrode 10 and the fixed electrode 20 is kept to be uniform over the whole electrode area.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims.

What is claimed is:

1. A microphone, comprising a vibration electrode disposed in an upper portion of a substrate which has an acoustic hole;

a fixed electrode separated from an upper portion of the vibration electrode by a reference distance and having an insulation membrane on each of an upper surface and a lower surface of the fixed electrode; and a piezoelectric electrode having a plurality of beams disposed in a radial direction outwards from a center of an upper portion of the fixed electrode and uniformly maintaining a space between the vibration electrode and the fixed electrode by bending the fixed electrode in one direction according to an input voltage.

2. The microphone of claim 1, wherein:

the vibration electrode includes a plurality of inflow holes penetrating a portion corresponding to the acoustic hole.

3. The microphone of claim 1, wherein:

a first sacrificial layer is disposed between the vibration electrode and the substrate.

4. The microphone of claim 1, wherein the fixed electrode is separated from the vibration electrode by a second sacrificial layer which is disposed on the upper portion of the vibration electrode.

5. The microphone of claim 1, wherein the fixed electrode has a plurality of air holes, and the air holes penetrate an area in which the piezoelectric electrode is not disposed.

6. The microphone of claim 1, wherein:

the fixed electrode further comprises a plurality of flexible springs extending outwards along an edge of the fixed electrode.

7. The microphone of claim 6, wherein:

the flexible spring is disposed along a circumference of the fixed electrode in an area in which the piezoelectric electrode is not disposed.

8. The microphone of claim 1, wherein:

a metallic layer is disposed on each of an upper surface and a lower surface of the piezoelectric electrode.

9. The microphone of claim 1, wherein:

the piezoelectric electrode is made of a piezo material including lead zirconate titanate (PZT).

10. The microphone of claim 1, further comprising:

a first electrode pad connected with the vibration electrode and a second electrode pad connected with the fixed electrode, wherein the first electrode pad and the second electrode pad are connected electrically with a semiconductor chip.

11. A method for manufacturing a microphone, the method comprising steps of:

forming a vibration electrode in an upper portion of a substrate;

forming a fixed electrode in an upper portion of the vibration electrode, the fixed electrode separated from the vibration electrode by a reference distance; and forming a piezoelectric electrode having a plurality of beams disposed in a radial direction outwards from a center of an upper portion of the fixed electrode and uniformly maintaining a space between the vibration electrode and the fixed electrode by bending the fixed electrode in one direction according to an input voltage.

12. The method of claim 11, wherein the step of forming the vibration electrode comprises:

forming a first sacrificial layer on the upper portion of the substrate; and forming the vibration electrode having a plurality of inflow holes in an upper portion of the first sacrificial layer.

13. The method of claim 11, wherein:

the step of forming the fixed electrode forms a second sacrificial layer in the upper portion of the vibration electrode, forms a first insulating layer on an upper portion of the second sacrificial layer, and then forms the fixed electrode having a plurality of air holes in an upper portion of the first insulating layer.

14. The method of claim 13, further comprising after the step of forming the fixed electrode:

forming a first electrode pad groove connected with the vibration electrode by etching the second sacrificial layer and a portion of the first insulating layer simultaneously; and forming a second insulating layer in an area of the first insulating layer and the upper portion of the fixed electrode, the area not including the air hole and first electrode pad groove.

15. The method of claim 11, wherein the step of forming the piezoelectric electrode:

forms a first metallic layer in an upper portion of the second insulating layer formed in an upper portion of the fixed electrode and forms a piezoelectric electrode in an upper portion of the first metallic layer.

16. The method of claim 15, further comprising, after the step of forming the piezoelectric electrode:

forming a first electrode pad connected with the vibration electrode and a second electrode pad connected with the fixed electrode while forming a second metallic layer in an upper portion of the piezoelectric electrode simultaneously.

17. The method of claim 11, further comprising, after the step of forming the piezoelectric electrode:

forming an acoustic hole by etching a central portion of the substrate; and forming an air layer in the space between the vibration electrode and the fixed electrode corresponding to the acoustic hole.

* * * * *